US005842416A

United States Patent [19]

Olawsky et al.

[11] Patent Number: 5,842,416

[45] Date of Patent: Dec. 1, 1998

[54] INKING UNIT FOR A PRINTING MACHINE

[75] Inventors: Klaus Olawsky, Weinheim; Norbert Thünker, Hirschberg, both of Germany

[73] Assignee: Heidelberger Druckmaschinen Aktiengesellschaft, Heidelberg, Germany

[21] Appl. No.: 851,018

[22] Filed: May 5, 1997

[30] Foreign Application Priority Data

May 3, 1996 [DE] Germany ..... 196 17 746.4

[51] Int. Cl.[6] ..... B41F 31/04; B41F 31/06

[52] U.S. Cl. ..... 101/350.1; 101/365

[58] Field of Search ..... 101/349.1, 350.1, 101/350.2, 350.4, 350.5, 350.6, 351.1, 351.4, 352.01, 352.05, 148, 157, 169, 423, 425, 365

[56] References Cited

U.S. PATENT DOCUMENTS

| | | | |
|---|---|---|---|
| 3,187,670 | 6/1965 | Jennings et al. | 101/425 |
| 3,283,712 | 11/1966 | Chambon | 101/350 |
| 4,782,756 | 11/1988 | Howard | 101/425 |
| 5,103,723 | 4/1992 | Maier | 101/153 |

FOREIGN PATENT DOCUMENTS

| | | |
|---|---|---|
| 141971 | 6/1980 | German Dem. Rep. . |
| 2530109 | 1/1977 | Germany . |
| 3324893C1 | 3/1985 | Germany . |
| 88-069651 | 3/1963 | Japan . |

OTHER PUBLICATIONS

"Neue Kurzfarbwerktechnik mit 'schwingender Rakel' für Zeitungsrollenoffsetmachinen" (Loy), wo4 Deutscher Drucker, No. 36, 1995.

*Primary Examiner*—J. Reed Fisher

*Attorney, Agent, or Firm*—Herbert L. Lerner; Laurence A. Greenberg

[57] ABSTRACT

An inking unit for a printing machine, including an ink duct with a scoop cylinder partly dipping into ink received in the ink duct, further includes zonally acting metering elements for setting on a provided cylinder selected from a group thereof consisting of the scoop cylinder and another cylinder, an ink distribution corresponding to a printing image, the metering elements being individually convertible between two metering states, at least one transfer cylinder for transferring ink, which has been set on the provided cylinder by the metering elements, onto a printing form, a drive for rotating the scoop cylinder and further cylinders, and a control device connected to the drive and the metering elements, the metering elements being arranged above the level of the ink in the ink duct, so that two ink layer thicknesses differing from one another are producible in circumferential direction, over the width of a metering element, by the metering elements, respectively, in the two metering states, on the provided cylinder assigned thereto, the transfer cylinder being disposed in parallel with the provided cylinder to which the metering elements are assigned, the provided cylinder and the transfer cylinder having a clearance therebetween which is larger than a minimum ink layer thickness producible by the metering elements and smaller than a maximum ink layer thickness producible by the metering elements.

11 Claims, 6 Drawing Sheets

1
2
3
4
5
6
7
8
9
10

INKING UNIT FOR A PRINTING MACHINE

BACKGROUND OF THE INVENTION

FIELD OF THE INVENTION

The invention relates to an inking unit for a printing machine, a series of cylinders or rollers being provided in the inking unit for inking a printing form, and metering elements for aiding the cylinders or rollers to produce an ink distribution corresponding to a printing image. The published German Patent Document 25 30 109 A1 and the published Japanese Patent Document JP 63-69615A describe inking units with an ink fountain or duct, a duct roller, an ink transfer roller and a plurality of inking unit rollers, wherein ink blades are provided which are capable of being engaged with or thrown onto and disengaged from or thrown off the duct roller in a pulse-like manner. The quantity of ink present on and lying along the duct roller and varying in zones is transferred onto the remaining inking unit rollers by a film roller or a distributor roller.

A disadvantage of these heretofore known constructions is that the metering blades become deformed due to the hydrodynamic forces acting in the metering nip or gap, so that, when an ink blade becomes engaged with or thrown onto the duct roller, the supply of ink to the respective zones cannot be closed completely, as required, and metering in one zone exerts an undesirable influence on the metering of adjacent zones.

Furthermore, the use of short inking units has become conventional in newspaper printing, and in such units, the quantity of ink on an applicator roller can be metered by a page-wide doctor blade (the German periodical: Deutscher Drucker [German Printer], No. 36, Sep. 28, 1995, page W64). The applicator roller is arranged in rolling contact between a scoop roller, which dips partly into an ink fountain, and the plate cylinder. A rider roller thrown onto the applicator roller downstream from the doctor blade, as viewed in the direction of rotation of the applicator roller, effects a smoothening of the ink film before the ink is applied to the inking form. This inking unit, which has been constructed for uniform page-wide ink application, does not permit any finely controlled zonal ink metering, as is required in high-quality multicolor printing.

SUMMARY OF THE INVENTION

It is accordingly an object of the invention to provide an inking unit for a printing machine and, more particularly such an inking unit having zonal metering with which the accuracy of the ink metering is considerably improved over that for inking units of the prior art.

With the foregoing and other objects in view, there is provided, in accordance with the invention, an inking unit for a printing machine, including an ink duct with a scoop cylinder partly dipping into ink received in the ink duct, comprising zonally acting metering elements for setting on a provided cylinder selected from a group thereof consisting of the scoop cylinder and another cylinder, an ink distribution corresponding to a printing image, the metering elements being individually convertible between two metering states, at least one transfer cylinder for transferring ink, which has been set on the provided cylinder by the metering elements, onto a printing form, a drive for rotating the scoop cylinder and further cylinders, and a control device connected to the drive and the metering elements, the metering elements being arranged above the level of the ink in the ink duct, so that two ink layer thicknesses differing from one another are producible in circumferential direction, over the width of a metering element, by the metering elements, respectively, in the two metering states, on the provided cylinder assigned thereto, the transfer cylinder being disposed in parallel with the provided cylinder to which the metering elements are assigned, the provided cylinder and the transfer cylinder having a clearance therebetween which is larger than a minimum ink layer thickness producible by the metering elements and smaller than a maximum ink layer thickness producible by the metering elements.

In accordance with another feature of the invention, the scoop cylinder has a metering cylinder assigned thereto, the scoop cylinder and the metering cylinder having respective axes of rotation disposed parallel to one another and having a clearance therebetween which is smaller than the layer thickness of ink scooped on the scoop cylinder, the metering elements being formed as doctor blades, respectively, movable towards and away from the outer cylindrical surface of the metering cylinder, and the inking unit includes a stationary doctor blade assigned to the scoop cylinder and having a clearance relative to the scoop cylinder which is larger than the clearance between the scoop cylinder and the metering cylinder.

In accordance with a further feature of the invention, the metering cylinder is drivable at a higher rotational speed than the scoop cylinder.

In accordance with an added feature of the invention, for cleaning the scoop cylinder and the metering cylinder, the ink duct is movable away from the scoop cylinder so that the scoop cylinder is located above the level of the ink in the ink duct, and, in a cleaning position, a bridge cylinder is provided for connecting the scoop cylinder and the metering cylinder to one another, the metering cylinder being uncouplable from a drive thereof.

In accordance with an additional feature of the invention, the stationary doctor blade bears against the scoop cylinder when the ink duct is in the cleaning position.

In accordance with yet another feature of the invention, the metering doctor blade is engageable with the metering cylinder for cleaning.

In accordance with yet a further feature of the invention, the metering doctor blade is throwable on and off the metering cylinder rhythmically for cleaning.

In accordance with yet an added feature of the invention, the metering cylinder and the transfer cylinder assigned thereto are connected to one another by at least one bridge cylinder, and the metering cylinder and the transfer cylinder are uncoupled from respective drives thereof.

In accordance with yet an additional feature of the invention, a plurality of the metering doctor blades are assigned to the scoop cylinder.

In accordance with a concomitant feature of the invention, the ink duct is adjustable in elevation, the elevation of the ink duct being controllable automatically in accordance with the filling level of the ink in the ink duct.

In the inking unit according to the invention, the throwing on and off of the metering elements causes virtually no forces to be transmitted to the cylinder assigned to the metering elements, so that no metering errors due to sagging are to be expected. With the inking unit according to the invention, it is possible to interrupt the ink supply within a zone completely or to meter a considerable quantity of ink in a short time, with the result that the ink setting can have high dynamics. Such high requirements regarding dynamics occur, in particular, in inking units wherein metering is to be performed in accordance with the so-called dead-beat method. The metering elements are subjected to only slight mechanical stress, so that, as a result of the low wear, they have a long life.

Other features which are considered as characteristic for the invention are set forth in the appended claims.

Although the invention is illustrated and described herein as embodied in an inking unit for a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
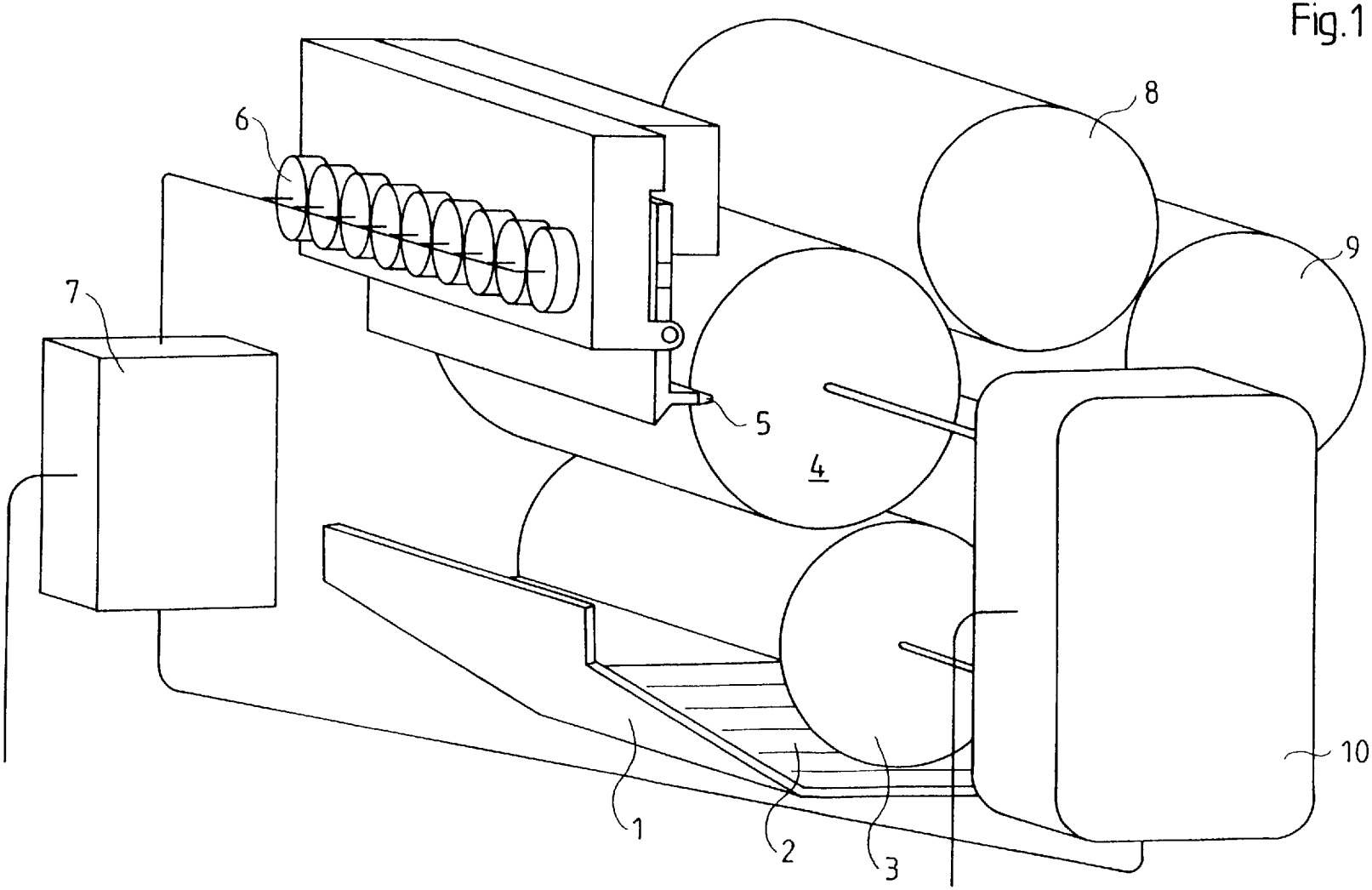
FIG. 1 is a diagrammatic perspective view of a zonal arrangement of metering doctors in a film-type inking unit according to the invention.

Referring now to the drawing and, first, particularly to FIG. 1 thereof, there are illustrated therein parts of an inking unit, including a scoop roller 3 partly dipping into ink 2 received in an ink duct or fountain 1. A metering cylinder 4 is arranged in parallel with the scoop roller 3. The scoop roller 3 and the metering cylinder 4 are provided with a mutual clearance relative to one another, so that they do not directly contact one another. The metering cylinder 4 has metering doctor blades 5 assigned thereto which are distributed uniformly over the width of the metering cylinder 4. The metering doctor blades 5 are coupled to magnetomechanical regulating elements 6, so that, under the control of a control device 7, they can be engageable and disengageable or thrown on and off individually in the direction of the outer surface of the metering cylinder 4. A transfer cylinder 8 is provided in parallel with the metering cylinder 4, no contact existing between the cylinders 4 and 8. An intermediate roller 9 is in rolling contact with the transfer cylinder 8. FIG. 1 illustrates diagramatically a drive system 10 to which the scoop roller 3 and the metering cylinder 4 are coupled. The drive system 10 is also connected to the control device 7.

Figure 2:
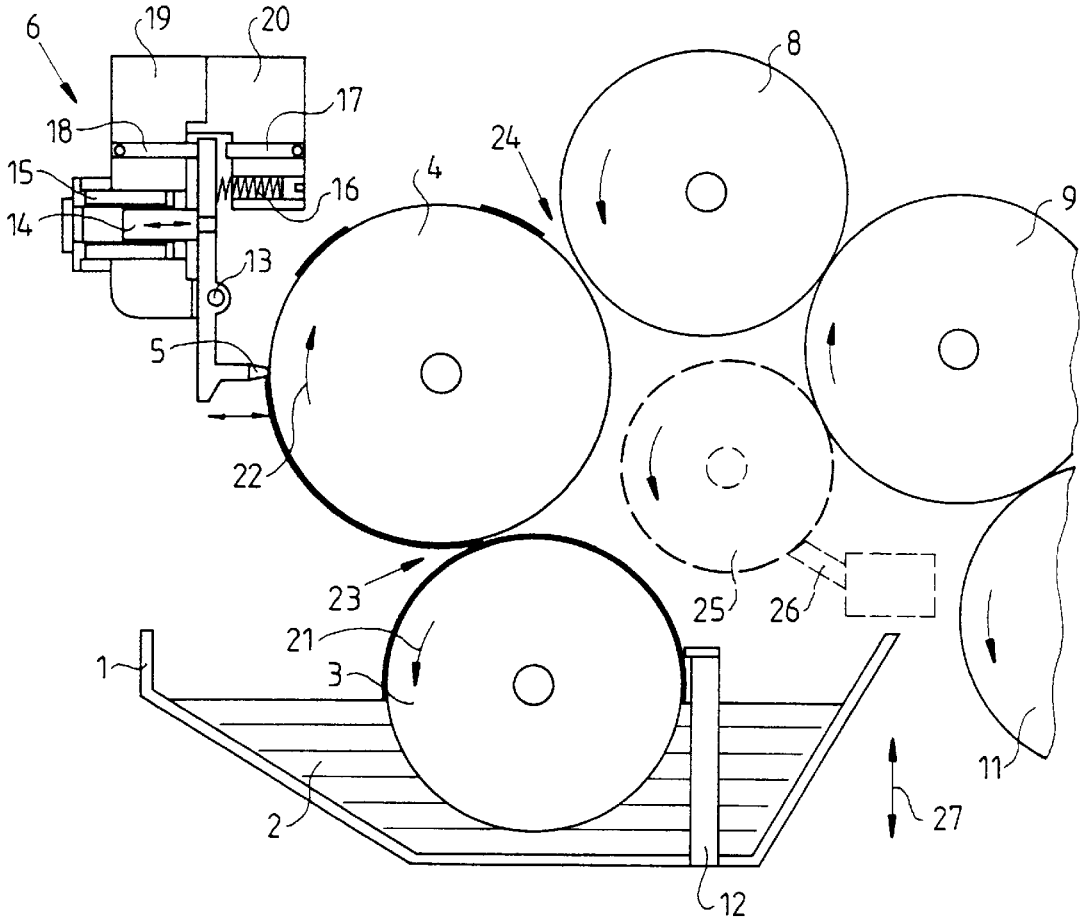
FIG. 2 is a diagrammatic side elevational view, partly in section, of FIG. 1.

As can be inferred further from the view of FIG. 2, a distributor roller 11 is located downstream of the intermediate roller 9, as viewed in the direction of ink transfer. Further non-illustrated rollers serve for transferring the ink onto a printing form. The scoop roller 3 has a coarse doctor blade 12 assigned thereto which is fastened, for example, to the bottom of the ink duct or fountain 1.

The metering doctor 5 is constructed as a two-armed lever and is mounted so as to be rotatable about a shaft 13. One arm of the lever is formed as the metering doctor blade 5, while the second arm is coupled to a plunger armature 14 which cooperates with an electric coil 15. Furthermore, a return spring 16 is provided on the second arm. The rotatable movement of the metering doctor blade 5 about the shaft 13 is limited by stops 17 and 18. All of the parts of the regulating elements 6 are fastened to holding elements 19 and 20.

How such a film-type inking unit functions is explained hereinafter: When the scoop roller 3 rotates in the direction represented by the curved arrow 21, ink 2 sufficient to provide a layer thickness of approximately 1 mm downstream of the coarse doctor blade 12, as viewed in the direction of rotation 21, is scooped up onto the surface of the scoop roller 3. By the fact that the metering cylinder 4 is driven somewhat more rapidly than the scoop roller 3 in the direction represented by the curved arrow 22, some of the ink is transferred from the scoop roller 3 onto the metering cylinder 4. An ink buildup in the transfer nip 23 is avoided due to the different rotational speeds of the scoop roller 3 and of the metering cylinder 4. When current flows through the coil 15, the plunger armature 14 is drawn into the coil 15. Due to the lever effect, the corresponding metering doctor blade 5 is thrown on in the direction of the outer surface of the metering cylinder 4, until the second arm of the metering doctor blade 5 bears against the stop 18. When the coil 15 is in a currentless state, the second arm is brought to bear on the stop 17, with the result that the metering doctor blade 5 is moved away from the outer surface. The two positioning states of the metering doctor blade 5 produce, between the respective metering doctor blade 5 and the outer surface of the metering cylinder 4, two different metering nips which amount, for example, to 0.1 mm and 0.5 mm. Regions having an ink layer thickness of 0.1 and 0.5 mm are located on the outer surface in the direction of rotation of the metering cylinder 4 indicated by the arrow 22, the size of the regions depending upon the time duration in which the metering doctor blade 5 assumes one position or the other and upon the rotational speed of the metering cylinder 4. The width of the digital transfer nip 24 between the metering cylinder 4 and the transfer cylinder 8 is smaller than 0.5 mm and greater than 0.1 mm, so that ink transfer onto the transfer cylinder 8 takes place in the regions on the metering cylinder 4 wherein the layer thickness amounts to 0.5 mm. The transfer of ink 2 to the transfer cylinder 8 via the intermediate roller 9 and the distributor roller 11 and via the aforementioned non-illustrated further rollers onto a printing form occurs in a conventional manner.

Figure 3:
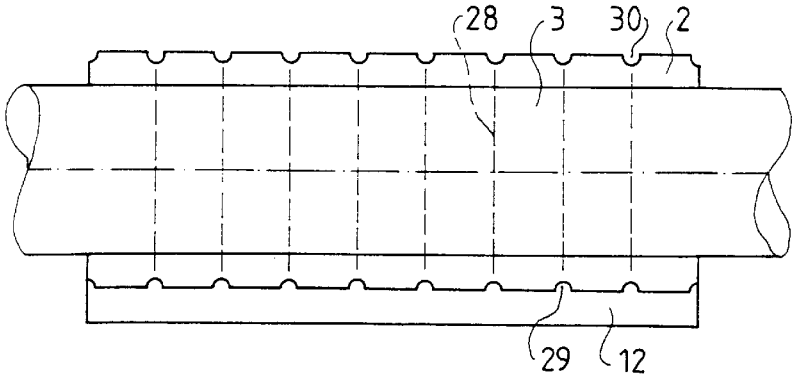
FIG. 3 is a fragmentary diagrammatic elevational view of a coarse doctor blade for providing a groove effect upon the ink layer, as seen from the left-hand side of FIG. 2.

In offset printing machines, wherein an emulsion of a dampening medium and of a printing ink 2 is applied to the printing form, a doctor roller 25 may additionally be thrown on or engaged with the intermediate roller 9, for example, in the inking unit. Excess dampening medium can be removed from the inking unit by an emulsion doctor blade 26 engaged with of thrown on the doctor roller 25. During metering by the metering doctors 5, only slight forces act on the metering cylinder 4, so that no disruptive sagging of the metering cylinder 4 occurs. The quantity of ink 2 transferred onto the transfer cylinder 8 may be set from zero to a maximum value. Because the metering doctors 5 do not come into contact with the surface of the metering cylinder 4, only extremely low wear occurs. The metering doctors 5 act outside the ink duct or fountain 1, so that the filling level of the ink 2 in the ink duct or fountain 1 exerts no influence on the metering. To clean the inking unit and to refill it with ink 2, provision may be made for the ink duct 1 to be lowerable and liftable in the direction represented by the double-headed arrow 27. The holding elements 19, 20 may likewise be arranged pivotably for the purpose of cleaning the metering doctors 5. By means of the individual drives of the scoop roller 3 and of the metering cylinder 4, it is possible to set different rotational speeds between these cylinders and the remaining rollers or cylinders 8, 9, 10. The stops 17, 18 may be designed adjustably, so that a simple setting of the stroke of the metering elements 5 is obtained. In order to avoid ink 2 being applied to the end faces of the scoop roller 3, a doctor may additionally be provided on the end faces. In order to avoid soiling the metering doctors 5 at the zone limits 28, the coarse doctor 12 may be provided with noses 29 (FIG. 3). Grooves 30 are thereby produced on the surface of the scoop roller 3 in the ink 2 at the zone limits 28.

The drive of the metering doctors 5 is magnetomechanical, but only by way of example. In principle, it is also possible to utilize regulating elements which exert a force action on the metering doctor blades 5 pneumatically, hydraulically or otherwise.

Figure 4:
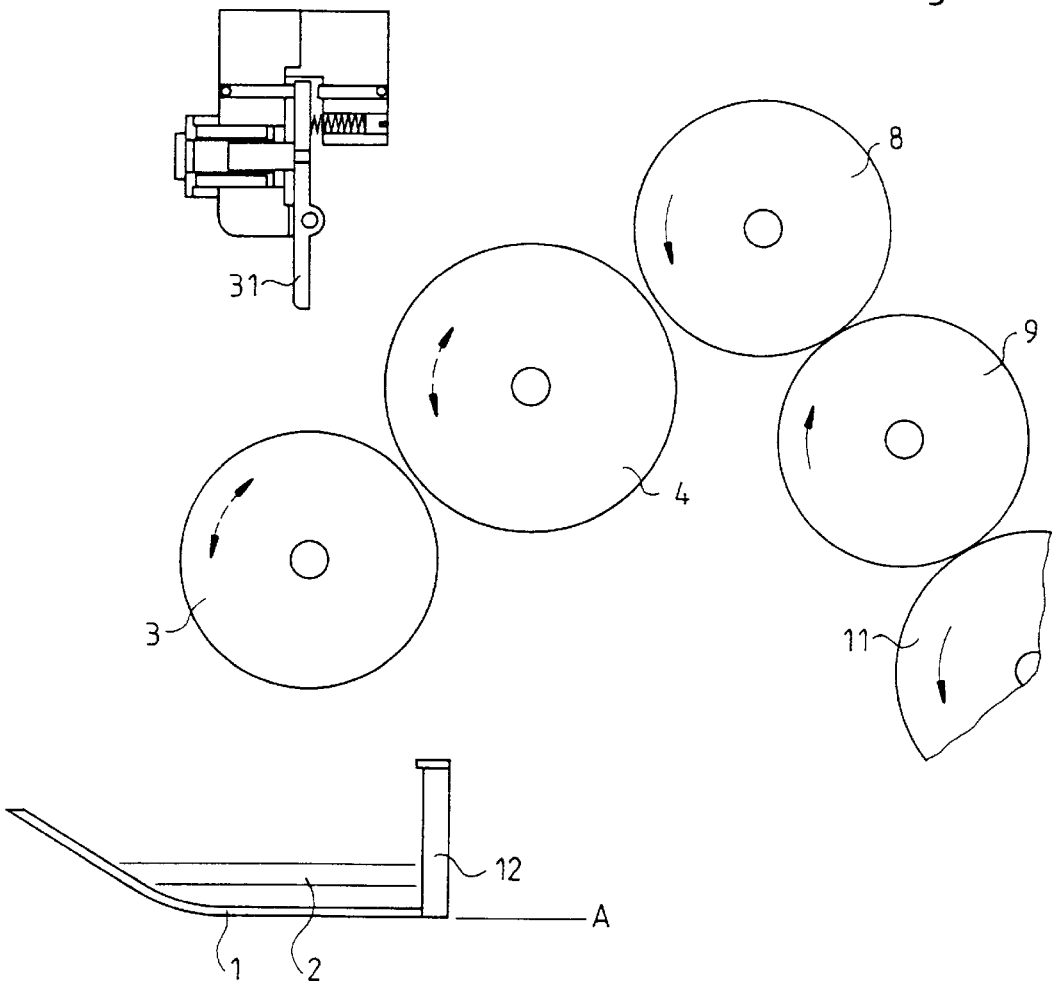
FIG. 4 is a view like that of FIG. 2 showing a different embodiment of the inking unit for facilitating cleaning.

One possibility for cleaning such an inking unit is provided herein with reference to FIG. 4. The transfer cylinder 8, the intermediate roller 9 and the distributor roller 11 are cleaned separately in a conventional manner. To clean the scoop roller 3 and the metering cylinder 4, the ink duct or fountain 1 is lowered into the position A, and the metering elements 31 are simultaneously brought into the cleaning position shown in FIG. 4. The scoop roller 3 and the metering cylinder 4 are freely accessible and can be cleaned manually with a spatula, liquid cleaning medium and a cloth. The direction of rotation of all of the rollers or cylinders of the inking unit can be reversed for cleaning purposes.

Figure 5:
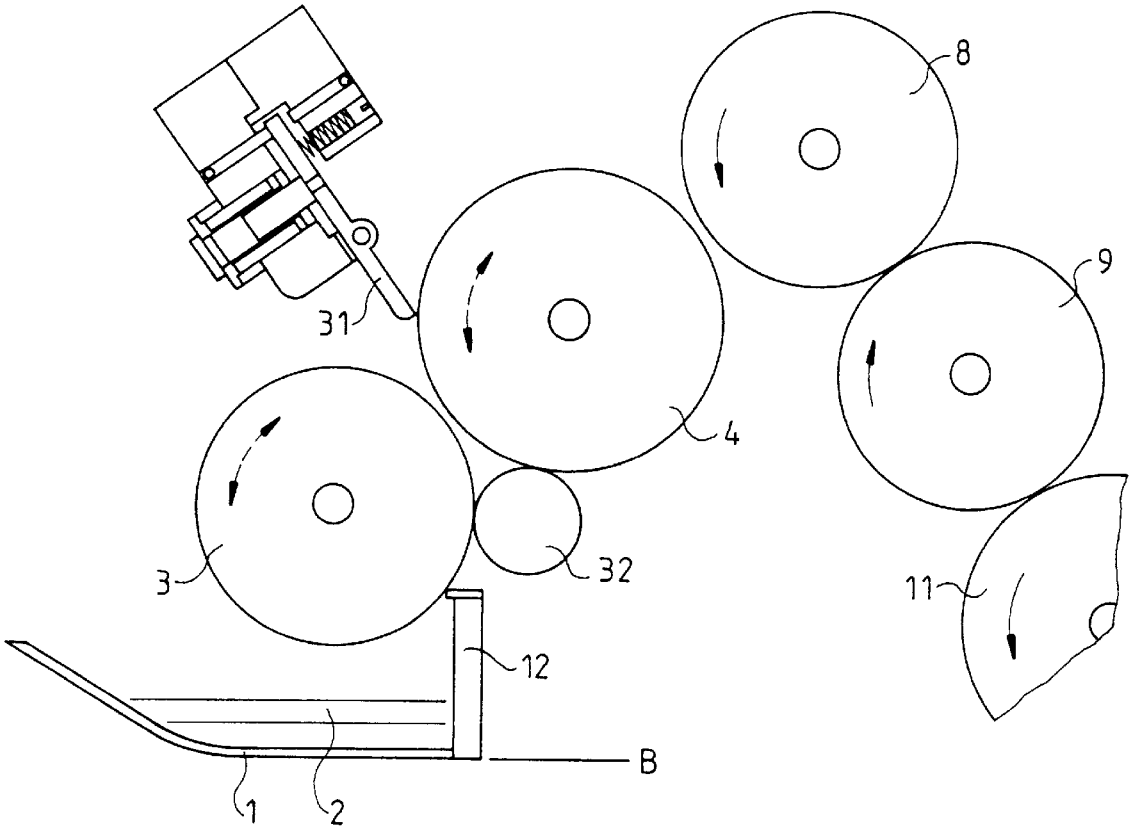
FIG. 5 is another view like that of FIG. 2 showing a film-type inking unit with a connecting roller for cleaning purposes.

In the embodiment shown in FIG. 5, the scoop roller 3 and the metering cylinder 4 are cleaned mechanically. A connecting roller 32 is provided for cleaning, the connecting roller 32 connecting the scoop roller 4 and the metering cylinder 4 in the cleaning position only. During cleaning, the metering cylinder 4 is uncoupled from the drive 10 thereof. The ink duct or fountain 1 is located in a cleaning position B wherein the coarse doctor blade 12 acts as a cleaning doctor blade, i.e., it bears against the surface of the scoop roller 3. The metering doctor blades 31 may additionally be engaged with or thrown on the metering cylinder 4 in contact with the latter. The metering doctor blades 31 are consequently cleaned therewith. During this mechanical cleaning, a liquid cleaning medium may likewise be applied.

Figure 6:
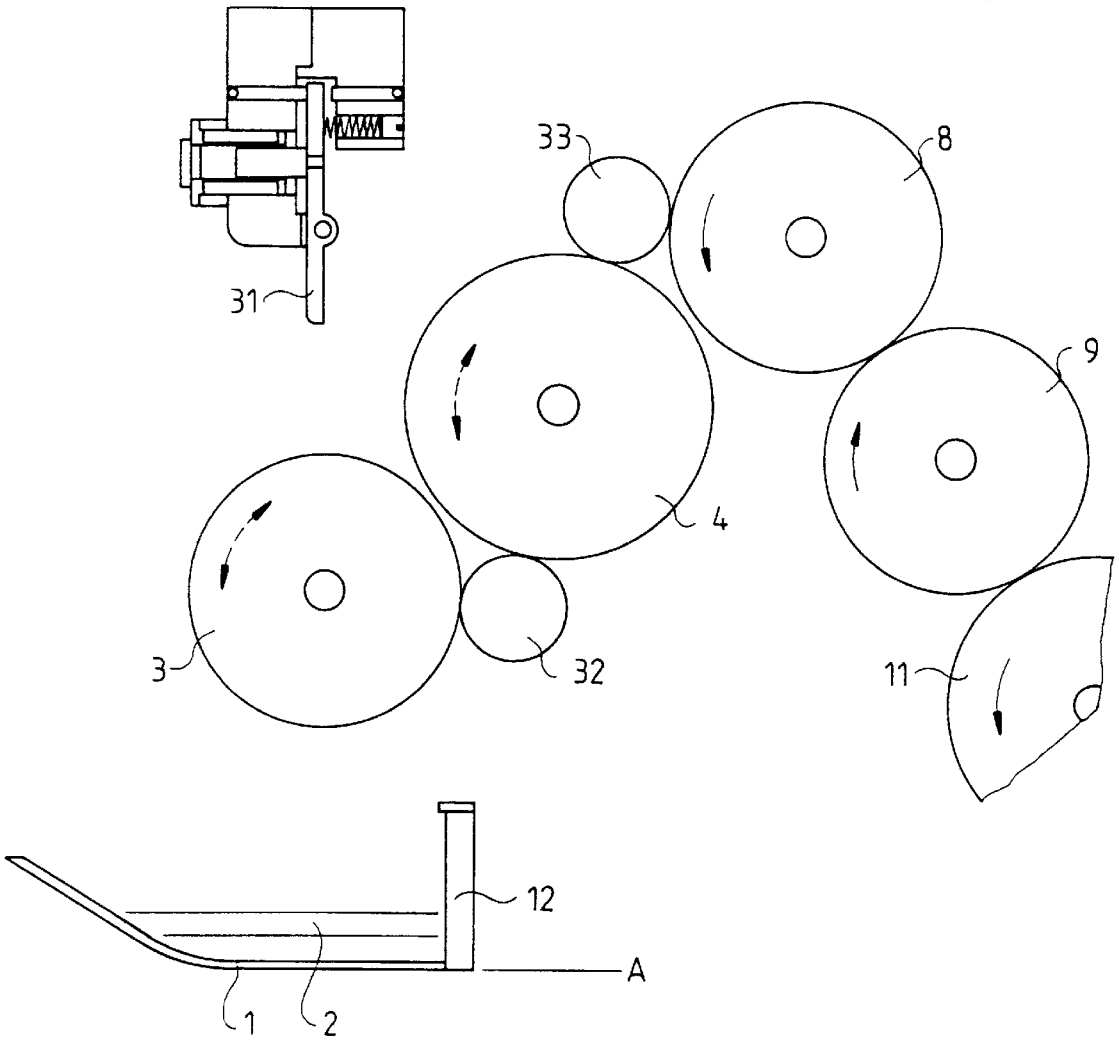
FIG. 6 is a further view like that of FIG. 2 showing a film-type inking unit with two connecting rollers for cleaning purposes.

In the embodiment according to FIG. 6, a further connecting roller 33 is provided between the metering cylinder 4 and the transfer cylinder 8. The ink duct or fountain 1 is lowered to the cleaning position A. The scoop roller 3 and the metering cylinder 4 are uncoupled from the drives 10 thereof. All of the rollers and cylinders, respectively, of the inking unit are consequently coupled in contact mechanically. The scoop roller 3 and the metering cylinder 4 are cleaned, together with the other rollers and cylinders, respectively, of the inking unit, in a conventional cleaning device.

In the cleaning position illustrated in FIG. 6, the metering doctor blades 31 can be cleaned manually by cleaning media, brushes or cloths. Continuous switching of the metering doctor blades 5 into the two possible positions, respectively, may assist manual cleaning.

Figure 7:
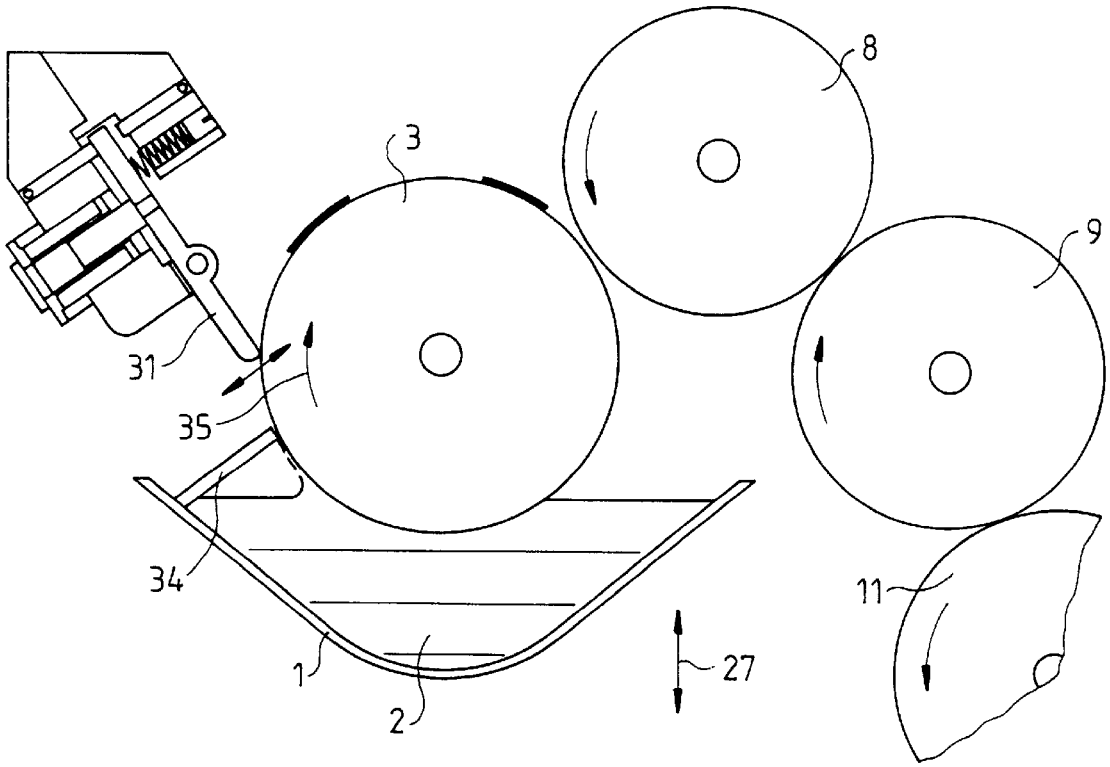
FIG. 7 is yet another view like that of FIG. 2 showing a film-type inking unit with an inclined metering doctor blade and with an ink duct having an adjustable height.

A further embodiment of an inking unit according to the invention is illustrated in FIG. 7. The metering doctor blades 31 are assigned directly to the scoop roller 3. This avoids any need for providing a separate metering cylinder. A doctor blade 34 provided in the ink duct or fountain 1 serves for premetering. When the scoop roller 3 rotates in the direction represented by the curved arrow 35, some of the scooped ink 2 is scraped off, so that an ink buildup in front or upstream of the metering doctor blades 31 is avoided. The height of the ink duct or fountain 1 is continuously readjusted, so that the depth to which the scoop roller 3 dips into the ink 2 remains substantially constant.

We claim:

1. An inking unit for a printing machine, comprising:

a rotatable metering cylinder having a surface for receiving a metering cylinder layer of ink;

a plurality of metering elements each mounted to be moveable between a first and a second position spaced respectively, a first and a second predetermined distance away from said surface of said metering cylinder, the second predetermined distance being greater than the first predetermined distance, whereby the layer of ink is formed on said surface at two discrete thicknesses corresponding to the first predetermined distance and the second predetermined distance;

a rotatable transfer cylinder extending parallel to said metering cylinder defining a clearance therebetween, said clearance being greater than the first distance and less than the second distance so that only a width of ink formed by a respective metering element moved to the second position is received onto said transfer cylinder from said metering cylinder.

2. The inking unit according to claim 1, wherein each one of said plurality of metering elements is mounted to be moveable to a third position in which a respective metering element is engaging said surface of said metering cylinder for cleaning the layer of the ink from said surface of said metering cylinder.

3. The inking unit according to claim 1, wherein each one of said plurality of metering elements includes a doctor blade.

4. An inking unit according to claim 1, wherein said plurality of metering elements are zonally mounted across said metering cylinder.

5. An inking unit according to claim 1, which further comprises an ink duct for receiving an ink, and in which said plurality of metering elements are mounted above the ink.

6. An inking unit according to claim 1, which further comprises a doctor blade mounted to be moveable between an engaged position in which said doctor blade engages said surface of said metering cylinder and an inoperative position in which said doctor blade is located remote from said surface of said metering cylinder.

7. The inking unit according to claim 1, which further comprises:

an ink duct for receiving an ink; and wherein said metering cylinder is disposed to partly dip into the ink to receive the metering cylinder layer of the ink.

8. The inking unit according to claim 1, which further comprises:

an ink duct for receiving an ink; and a scoop cylinder rotationally disposed in parallel with said metering cylinder and disposed to partly dip into the ink to receive a scoop cylinder layer of the ink and to deposit the metering cylinder layer of the ink onto said metering cylinder.

9. The inking unit according to claim 8, which further comprises a stationary doctor blade disposed adjacent said surface of said scoop cylinder to define a clearance therebetween which is greater than a clearance defined between said surface of said metering cylinder and a surface of said scoop cylinder.

10. The inking unit according to claim 1, which further comprises:

a scoop cylinder rotationally disposed in parallel with said metering cylinder;

an ink duct for receiving an ink, said ink duct mounted to be movable between an inking position where said scoop cylinder partly dips into the ink to receive a scoop cylinder layer of the ink and to deposit the metering cylinder layer of the ink onto said metering cylinder and a cleaning position where said scoop cylinder is not in contact with the ink; and a bridge cylinder rotationally disposed to be moveable between an inoperative position where said bridge cylinder is not in contact with said scoop cylinder and said metering cylinder and a cleaning position where said bridge cylinder is in contact with said scoop cylinder and said metering cylinder for cleaning said scoop cylinder and said metering cylinder.

11. The inking unit according to claim 1, which further comprises:

an ink duct mounted to have an adjustable elevation, said ink duct for receiving an ink;

a scoop cylinder rotationally disposed in parallel with said metering cylinder and partly dipping into the ink to receive a scoop cylinder layer of the ink and to deposit the metering cylinder layer of the ink onto said metering cylinder; and a controller automatically controlling said elevation of said ink duct as the ink is consumed so that said scoop cylinder remains partially submerged at a constant level within the ink as the ink is consumed.

* * * * *